United States Patent [19]

Brown

[11] 4,421,316

[45] Dec. 20, 1983

[54] THREE-FINGERED SPINNER GAME OF CHANCE

[76] Inventor: William F. Brown, 6215 S. Wabash Ave., Apt. 506, Chicago, Ill. 60637

[21] Appl. No.: 246,395

[22] Filed: Mar. 23, 1981

[51] Int. Cl.[3] ..... A63F 3/00

[52] U.S. Cl. ..... 273/274; 273/141 R

[58] Field of Search ..... 273/141 R, 141 A, 274, 273/246, DIG. 25

[56] References Cited

U.S. PATENT DOCUMENTS

| | | | |
|---|---|---|---|
| D. 96,199 | 7/1935 | Post | 273/141 R X |
| 1,221,791 | 4/1917 | Cook | 273/141 R |
| 1,538,967 | 5/1925 | Boardman | 273/141 R |
| 1,695,683 | 12/1928 | Culp | 273/141 R |
| 2,042,604 | 6/1936 | King | 273/141 A X |
| 2,473,675 | 6/1949 | Boreszewski | 273/141 R |
| 2,681,804 | 6/1954 | Stover | 273/DIG. 25 X |
| 2,727,746 | 12/1955 | Hawkes | 273/246 |
| 2,800,331 | 7/1957 | Hester | 273/141 A |
| 3,117,790 | 1/1964 | White | 273/141 R X |
| 3,232,622 | 2/1966 | Lambert | 273/141 A X |

*Primary Examiner*—Richard C. Pinkham
*Assistant Examiner*—Arnold W. Kramer
*Attorney, Agent, or Firm*—Paul H. Gallagher

[57] ABSTRACT

A game of chance simulating the betting in horse racing. A game board contains the numbers of hypothetical horses, and indications of odds paid on each horse in each position of that horse in the race, as Win, Place and Show. A wheel or roulette type indicator, includes a dial with the numbers of the horses arranged in a circle, and a rotatable arrow or spinner which upon being rotated or spun, and after stopping, indicates the horses in the particular race concerned. The spinner has three arms, each indicating a respective one of the horses as to its position, i.e., whether Win, Place or Show. A combinations chart is included, which shows the combinations of the positions of the first three horses in each race, that is, for each position of stopping of the indicator, a predetermined combination of horses constitute the first three in that race.

1 Claim, 7 Drawing Figures

FIG. 1.
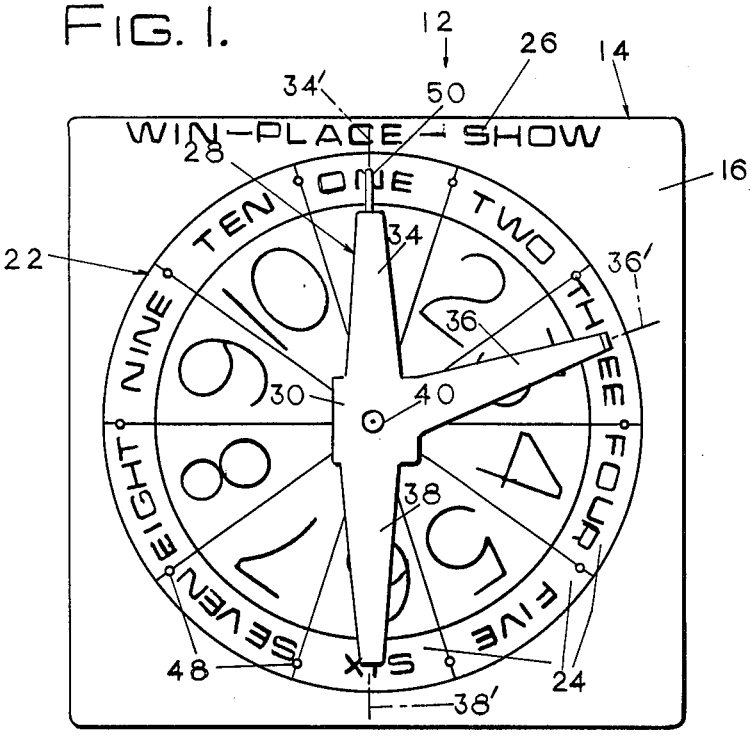
FIG. 4.
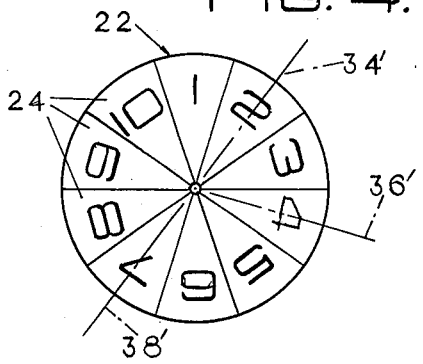
FIG. 5.
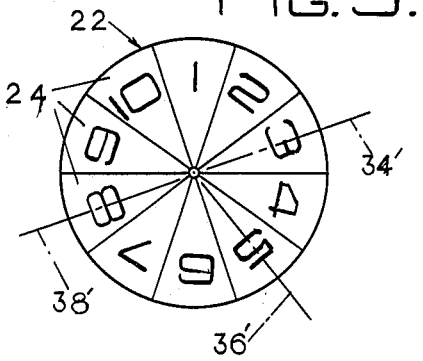
FIG. 2.
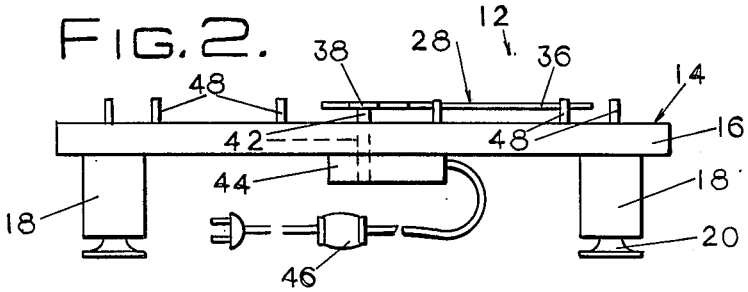
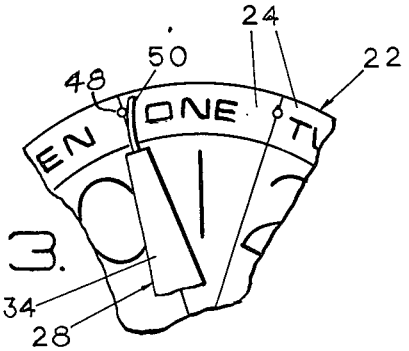
FIG. 3.

FIG. 6.

52

WIN - PLACE - SHOW

THE COMBINATIONS

| | WIN | PLACE | SHOW | | WIN | PLACE | SHOW | |
|---|---|---|---|---|---|---|---|---|
| 60 | 1 | 3 | 6 | | 2 | 4 | 7 | 62 |
| 64 | 3 | 5 | 8 | | 4 | 6 | 9 | 66 |
| 68 | 5 | 7 | 10 | | 6 | 8 | 1 | 70 |
| 72 | 7 | 9 | 2 | | 8 | 10 | 3 | 74 |
| 76 | 9 | 1 | 4 | | 10 | 2 | 5 | 78 |
| | 54 | 56 | 58 | | 54 | 56 | 58 | |

FIG. 7.

| | | | | | | | | | | |
|---|---|---|---|---|---|---|---|---|---|---|
| WIN 80 | ODDS 4-1 | ODDS 4-1 | ODDS 4-1 | ODDS 4-1 | ODDS 4-1 | ODDS 4-1 | ODDS 4-1 | ODDS 4-1 | ODDS 4-1 | ODDS 4-1 |
| | 1 | 2 | 3 | 4 | 5 | 6 | 7 | 8 | 9 | 10 |
| PLACE 82 | ODDS 2-1 | ODDS 2-1 | ODDS 2-1 | ODDS 2-1 | ODDS 2-1 | ODDS 2-1 | ODDS 2-1 | ODDS 2-1 | ODDS 2-1 | ODDS 2-1 |
| | 1 | 2 | 3 | 4 | 5 | 6 | 7 | 8 | 9 | 10 |
| SHOW 84 | ODDS 1-1 | ODDS 1-1 | ODDS 1-1 | ODDS 1-1 | ODDS 1-1 | ODDS 1-1 | ODDS 1-1 | ODDS 1-1 | ODDS 1-1 | ODDS 1-1 |
| | 1 | 2 | 3 | 4 | 5 | 6 | 7 | 8 | 9 | 10 |

THREE-FINGERED SPINNER GAME OF CHANCE

OBJECTS OF THE INVENTION

A broad object of the invention is to provide a game of chance simulating the betting in horse racing, having such similarity to a horse race in both the manner of placing bets and paying off, as to provide an unusual appeal to those interested in horse racing.

Another object is to provide such a game wherein the determining of the prevailing horses in each race is done in an unusual way as to be of great interest to the players.

Another object is to provide a game of the foregoing character having such novel features that in the playing thereof, the players can quickly observe the results of each race.

A further object is to provide a game of the foregoing character which is readily adaptable, as physical equipment, to small-scale character for use in a home, and alternatively to more elaborate character for use in a public betting place.

DESCRIPTION OF A PREFERRED EMBODIMENT

In the drawings:

FIG. 1 is a face view of a main component of the game, designated a "wheel";

FIG. 2 is a side view of the wheel of FIG. 1;

FIG. 3 is a fragment of the view of FIG. 1 showing the indicator in a position slightly removed from that of FIG. 1;

FIG. 4 is a diagrammatic view of the wheel showing the indicator in an alternate position;

FIG. 5 is a view similar to FIG. 4 showing the indicator in a still different alternate position;

FIG. 6 is a view of a combinations chart showing Win, Place and Show positions; and FIG. 7 is a view of the game board.

As is generally known, the first, second and third winning positions in a horse race are Win, Place and Show, respectively. This game therefore may be known also as "Win, Place and Show".

Referring generally to the game apparatus, the component of FIGS. 1–5 is designated a wheel and is utilized for randomly selecting the successful horses in a race, namely those in Win, Place and Show positions. The component of FIG. 7 is designated a game board, and is provided with areas representing the various horses by number, and including the respective Win, Place and Show positions, and the odds relating to those positions. The bets are placed on this game board. The component of FIG. 6 is a combinations chart, showing the combinations of the successful horses in each of ten possible positions, i.e., for every Win position, the corresponding Place and Show position is indicated.

The wheel of FIGS. 1–5, designated 12 is portable in the form shown as preferred for home use for example, and in such form includes a table 14 with a table top 16 mounted on suitable legs 18 having suction cups 20. On the face of the table top 16 is a dial 22 which may be either imprinted on the table top, or in the form of a layer or lamination applied thereto. The game as herein exemplified is set up for ten horses, suitably indicated by the numerals 1 to 10 inclusive, in each of the three components, and in accordance therewith the dial 22 is divided into ten parts or spots 24 of wedge shape, and each including the corresponding number of the respective horse, both in numerals and letters. A label 26 may also be applied to the table top bearing the name of the game, —"Win, Place and Show."

A rotatable arrow or spinner 28 is provided for randomly designating the numbers of the horses, in playing the game. The spinner 28 includes a hub 30 and fingers or prongs 34, 36, 38, these fingers being also designated by respective center lines 34', 36', 38', as particularly in FIGS. 4 and 5. The spinner 28 is of generally star shape and the mutual arrangement of these fingers will be referred to again hereinbelow.

In the preferred form of the wheel 12, as in a portable device for domestic use, for example, the spinner 28 is demountably put in position. This may be done by providing an aperture 40 and frictionally fitting it on a pin or shaft 42 which is the drive shaft of an electric motor 44 mounted on the underside of the table top with the shaft extending up through the table. The motor is controlled by an ordinary switch 46 which may be a conventional ON-OFF switch, so that the controller or operator, in actuating the wheel, merely turns on the motor for a few seconds, and the spinner is rotated or spun, and he turns it off and the arrow coasts to a stop.

Secured in the table top are pins 48 in the dial 22 adjacent the periphery of the latter, these pins also being ten in number and positioned between adjacent segments 24. The finger 34 is provided with a flexible leaf 50 extending longitudinally outwardly, and the finger and the leaf are dimensioned so that the leaf extends slightly beyond the pins 48, and when the spinner stops at a position close to the dividing lines between segments as indicated by the pins 48, the leaf 50 will be on one side or the other of a pin to positively indicate the segment 24 that is randomly selected.

The fingers of the spinner 38 are at a pre-determined relative angular displacement, not necessarily, and preferably not, at uniform angles. In this case the finger 36 is angularly displaced at 72° from the finger 34, representing two segments 24 of the dial, and the finger 38 is displaced 108° from the finger 36, this spacing representing three segments 24. The finger 38 therefore is displaced 180° from the finger 34.

The relative positioning of the fingers 34, 36, 38 predetermines the second and third positions in any play, Place or Show, relative to the first or Win position.

In playing the game the controller rotates the spinner by actuating the switch 46 momentarily, as indicated above, and the motor 24 drives the spinner preferably at a relatively rapid speed, and after releasing the switch the spinner coasts to a stop, at a random position. Then for any given position of the finger 34, which is the Win position, the other fingers 36, 38 fall into pre-determined positions relative to that of the finger 34, representing Place and Show, respectively. In the present instance, assume that the spinner stops at the position shown in FIG. 1 with the finger 34 in the "1" position, i.e., that of the No. 1 horse, the finger 36 representing the Place position is at the No. 3 position. In this same relationship, the finger 38 will be at position No. 6, this being the Show position.

The combinations chart of FIG. 6, designated 52, includes all of the possible combinations of the Win, Place and Show positions in every rotation or spin of the spinner. As indicated above, the apparatus covers a ten-horse race, and these same ten horses are set out in respective combinations in the chart 52. The ten horses are arranged in two columns, the Win position at 54, the Place at 56, and the Show at 58. The horses making up each combination are arranged horizontally, and the combinations are spaced vertically, being respectively identified 60, 62, 64, 66, 68, 70, 72, 74, 76, 78. Thus in combination 60, of FIG. 6, which is that represented in FIG. 1, the No. 1 horse is in Win position, the No. 3 horse in Place position and the No. 6 in Show position. In the position of the spinner in FIG. 4, in combination 62, the Win position is No. 2, the Place position No. 4, and the Show position No. 7. In the position of the spinner in FIG. 5, in combination 64, the Win horse is No. 3, the Place No. 5, and the Show No. 8. Thus the chart 52 shows all of the possible combinations in the Win position of each horse.

The game board represented in FIG. 7 is positioned in a suitable place such as on a table and includes horizontal rows representing the Win, Place and Show positions 80, 82, 84, respectively, these rows being relatively spaced vertically. Each row includes the designation Win, Place or Show, and the numbers of the horses progressing horizontally in each case, and the odds in each position, in this case 4–1 in Win, 2–1 in Place, and 1–1 in Show.

In playing the game the players place their bets on the areas of the game board of FIG. 7, each on a horse identified by the number, and each in the respective position, Win or Place or Show. The controller then spins the spinner as referred to above, and upon its coming to rest, it randomly indicates the Win, Place and Show positions which determine the winnings according to the placement of the bets on the game board of FIG. 7. After the termination of that particular play, or race, the controller in accordance with usual betting practice, takes in the bets and pays the winnings.

The bettors can of course observe the position of the spinner 28 in each play, and determine their own position, whether Win, Place or Show, but in order to facilitate such observation, and to avoid any confusion, the combinations chart of FIG. 6 greatly assists the bettors, since they can at a glance determine the Place and Show positions corresponding to each Win position and this also will be an aid in determining where to place bets particularly for Place and Show, for any given expected or hoped for Win position. The psychological effect of being able to observe this combinations chart will have a good result in the attitude of the bettors.

I claim:

1. A game of chance simulating a horse race and betting thereon comprising, a wheel including a table having a dial thereon with a circumferential series of areas each having indicia thereon identifying a respective one of a plurality of horses, a spinner on the table cooperating with the dial and having a hub, and three fingers extending radially in overlying relation to the indicia identifications of the horses and thereby effective for indicating respective ones of the horses, the fingers extending to positions closely adjacent the periphery of the dial and being angularly spaced apart for indicating different horses for Win, Place and Show positions, and the spaces between the fingers enabling visualization of the selections by players in a group, a combinations chart of indicia identifying combinations of indicia of horses, each combination including Win, Place and Show horses in correlation to the combinations indicated by the spinner for every position of the spinner, and the combinations of indicia in the combinations chart for Win being arranged in sequence according to the sequence of indicia representing horses on the dial with the combinations for each Place and Show being arranged with respect to Win according to the spacing of the indicia indicated by the fingers of the spinner, the combinations chart being of such size and proportions as to enable players in a group to read it at a glance, and a game board displaying the indicia identification of all the horses and the odds for payment on each, in each Win, Place and Show position, the game board being of such size and proportions as to enable the players to place bets thereon.

* * * * *